US005129987A

United States Patent [19]

Joachimides et al.

[11] Patent Number: 5,129,987

[45] Date of Patent: Jul. 14, 1992

[54] PROCESS FOR BLEACHING MECHANICAL WOOD PULP WITH SODIUM HYDROSULFITE AND SODIUM HYDROXIDE IN A REFINER

[75] Inventors: Thomas Joachimides, East Hampstead, N.H.; Stephen H. Levis, Haverhill, Mass.; Bert A. Edstrom, Njurunda; Hans B. S. Moldenius, Kristianstad, both of Sweden

[73] Assignee: Morton Thiokol, Inc., Chicago, Ill.

[21] Appl. No.: 506,576

[22] Filed: Apr. 9, 1990

Related U.S. Application Data

[63] Continuation of Ser. No. 324,179, Mar. 16, 1989, abandoned.

[30] Foreign Application Priority Data

Mar. 16, 1988 [GB] United Kingdom ..... 8806206

[51] Int. Cl.[5] ..... D21B 1/16; D21C 9/10

[52] U.S. Cl. ..... 162/25; 162/26; 162/28; 162/76; 162/83; 162/86

[58] Field of Search ..... 162/25, 76, 26, 28, 162/83, 84, 86; 252/188

[56] References Cited

U.S. PATENT DOCUMENTS

| | | | |
|---|---|---|---|
| 3,388,037 | 6/1988 | Asplund et al. | 162/26 |
| 3,467,574 | 9/1969 | West | 162/26 |
| 3,804,944 | 4/1974 | Kise et al. | 252/188 |
| 3,985,674 | 10/1976 | Ellis et al. | 162/83 |
| 4,534,954 | 8/1985 | Little et al. | 423/515 |
| 4,676,961 | 6/1987 | Appl et al. | 423/265 |
| 4,756,799 | 7/1988 | Bengtsson et al. | 162/28 |

FOREIGN PATENT DOCUMENTS

| | | |
|---|---|---|
| A3602088 | 8/1986 | Fed. Rep. of Germany . |
| A236780 | 5/1978 | France . |
| A7900861 | 11/1979 | PCT Int'l Appl. . |
| 1002435 | 3/1983 | U.S.S.R. . |
| 974309 | 11/1964 | United Kingdom . |
| A1588140 | 4/1981 | United Kingdom . |

OTHER PUBLICATIONS

Meizer et al, paper given to the Wood Pulp Symposium in Munich in 1985.

Search Report U.K. Appl No. 8806206.

Barton et al., Pulp Paper 53, No. 6 pp. 180–181.

Canadian Pulp and Paper Association, 65th Annual Meeting Book "A" Preprints, W. Gandy, pp. A17 and A18 (1979).

1979 Int'l. Mechanical Pulping Conference, J. Lansford, "Rejects Refining and Bleaching of Mechanical Pulp", pp. 323, 324 (1979).

Loras, V., "Brightening of Thermechanical Pulp", Tappi vol. 59, No. 11, pp. 99–101 (Nov. 1976).

*Primary Examiner*—Steve Alvo

*Attorney, Agent, or Firm*—George W. Rauchfuss, Jr.; Gerald K. White

[57] ABSTRACT

A paper pulp refining and bleaching process wherein the pulp is treated in one or more refiners with a sodium hydrosulfite bleach liquor in the presence of a strong alkali such as NaOH, whereby the bleaching solution has an alkaline pH, preferably 10 to 12, and the pulp is discharged from the refiner at a pH of from about 5 to 6. The bleaching produces a brightness gain of at least 8 to 13 ISO points in the refiners. The process is preferably carried out by passing the pulp successively through a primary refiner at elevated pressure, a secondary refiner at atmospheric pressure and a bleaching tower, an alkaline hydrosulfite solution being fed to each.

16 Claims, 8 Drawing Sheets

PROCESS FOR BLEACHING MECHANICAL WOOD PULP WITH SODIUM HYDROSULFITE AND SODIUM HYDROXIDE IN A REFINER

This is a continuation of copending application Ser. No. 07/324,179 filed on Mar. 16, 1989, now abandoned.

BACKGROUND OF THE INVENTION

1. Field of the Invention

This invention relates to a process for bleaching mechanical wood pulp with sodium hydrosulfite as part of a refining process.

2. Description of the Prior Art

In a typical conventional pulp refining process, wood chips or the like are subjected to two or more refining stages, in which they are ground mechanically by rotating grinding wheels or discs and then to a bleaching stage to remove chromophores and increase the brightness of the pulp.

The first refining stage is generally carried out using steam of an elevated pressure, suitably 100–200 KPa. The subsequent refining stages can be carried out at atmospheric pressure. The resulting pulp is then subjected to post-bleaching in a tower or chest, at low to medium consistency.

The most commonly used pulp bleaching agents are hydrogen peroxide, $H_2O_2$, and sodium hydrosulfite, $Na_2S_2O_4$, also known as sodium dithionite. Whilst the peroxide generally provides greater brightness gains, it is relatively expensive and the hydrosulfite is therefore more commonly utilized. This compound cannot however be used at high concentration since its decomposition products tend to act as catalysts, promoting the decomposition of the hydrosulfite and inhibiting its bleaching activity.

Barton and Treadway, in Pulp Paper 53, No. 6. pp. 180–181 propose feeding a part of the hydrosulfite to a refining stage before the pulp reaches the bleaching tower. The elevated temperature (typically 145° F., 65.5° C.) and high pulp consistency were found to offer considerable advantages, as was the absence of air in a pressurised refiner. Rather than increase the total amount of hydrosulfite used, Barton and Treadway reduced the hydrosulfite concentration in the bleaching tower, splitting the total between the refiner and the tower.

Melzer and Auhorn, in a paper given to the Wood Pulp Symposium in Munich in 1985, showed how the total hydrosulfite input could be reduced by feeding the greater part of the hydrosulfite used to the first stage of a two-stage refining process at pH 6, and adding the rest to the refined pulp before it entered a bleaching tower. This also gave a marked saving in energy consumption to produce the same mechanical pulp properties, or improved strength characteristics for the same energy input. No improvement in brightness was noted, however.

SUMMARY OF THE INVENTION

It is accordingly an object of the present invention to provide a hydrosulfite pulp bleaching process which gives pulp of improved brightness without the need to increase significantly either the energy input or the overall amount of hydrosulfite used.

This object is achieved in accordance with the present invention in a pulp refining and bleaching process of the above type, in that the pulp is treated in a refiner with a sodium hydrosulfite bleach liquor in the presence of a strong alkali, whereby bleaching takes place at an alkaline pH, preferably of 8 to 13 and more preferably 10 to 12.

The pulp is preferably bleached in a pressurized refiner Further bleaching may take place in a second, atmospheric refiner and/or in a bleaching tower.

The bleaching liquor can be brought to the desired pH with a strong alkali such as sodium hydroxide. This is preferably added to a concentration based on the pulp of not more than 1 wt. % preferably 0.8–1 wt. %. The final pH of the pulp leaving the refiner is generally in the range 5–6, suggesting that the main function of the alkali is a neutralizing one.

The total amount of hydrosulfite used need not exceed 2 wt. % based on the pulp, and in preferred processes in accordance with the invention need not exceed 1 wt. %.

Adding the hydrosulfite to a primary pressurized refiner alone, an addition rate of 0.3 to 2% has been found to give a brightness gain of 10 points, while a similar gain can be obtained from a 1% overall addition split between the primary reactor and a secondary (atmospheric) reactor. For example, a 6 point brightness gain has been obtained with a hydrosulfite charge to the primary refiner of 0.25 to 0.50%, with a further 4 points gained by feeding the remaining 0.75 to 0.50% to the secondary refiner.

The refining zone presents an efficient mass transfer system (i.e. vigorous mixing) as well as an air-free environment that contributes to an increased effectiveness of bleaching. The resulting higher temperature and higher consistencies presumably increase the bleaching reaction rate that reduces the lignin chromophores. The continual fracture of wood produces new surfaces and continually exposes the lignin chromophores to reduction. The strong alkali in the bleach liquor stabilizes the hydrosulfite and neutralizes the wood acids as they are released from the wood chips. Preferred processes in accordance with the invention as will be shown, have given brightness gains in the range of 10 to 13 points. Typical tower bleaching of softwood TMP results in brightness gains of 6 to 8 points.

A chelating agent may be added to the system before or during refining, such as ethylene diamine tetraacetic acid (EDTA) or Diethylene tetramine pentaacetic acid (DTPA).

Further objects, features and advantages of the invention will become apparent from the following detailed description when read in conjunction with the accompanying drawings which illustrate preferred embodiments thereof.

DETAILED DESCRIPTION OF THE PREFERRED EMBODIMENT

Figure 1:
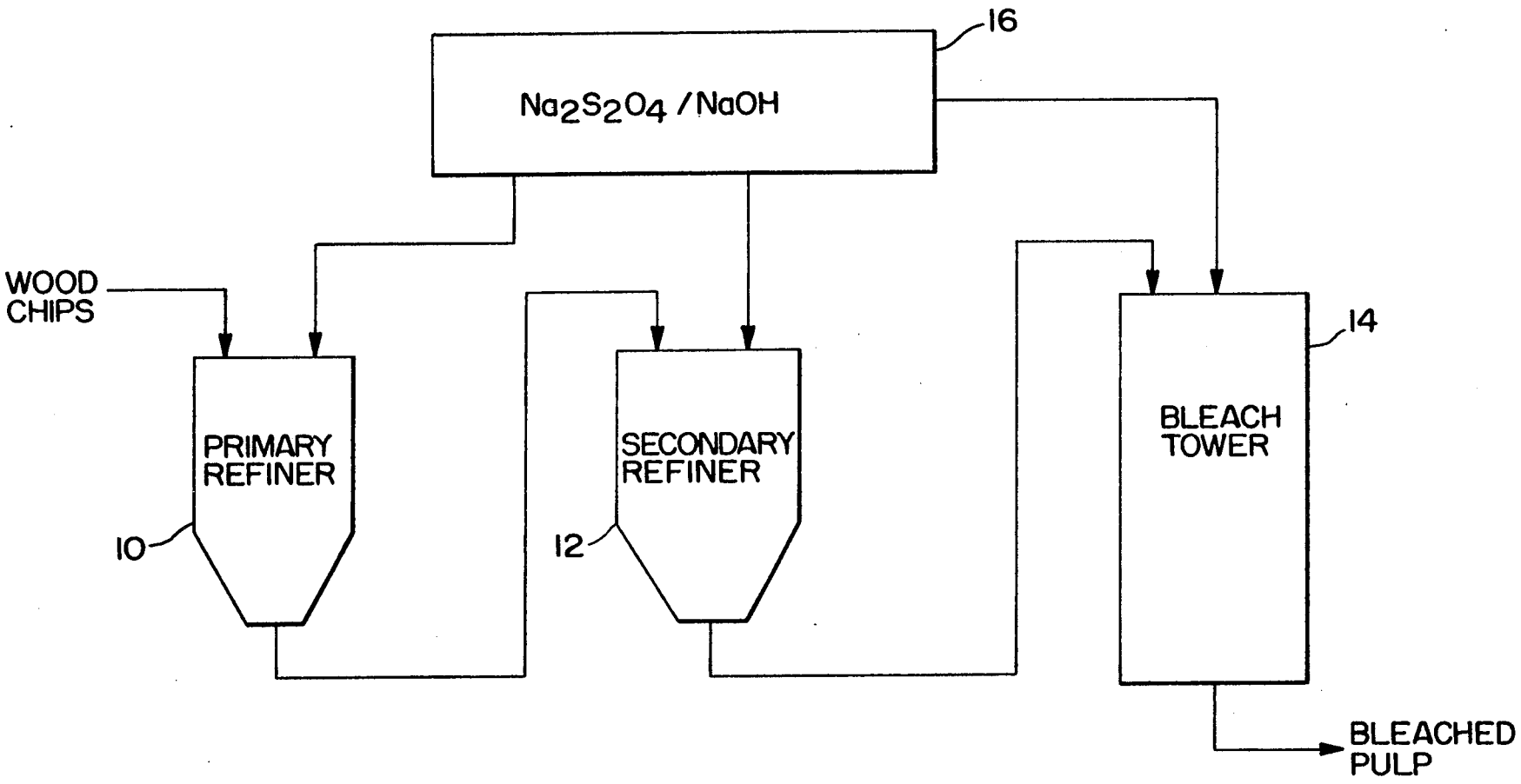
FIG. 1 shows schematically a process in accordance with a preferred embodiment of the invention.

Referring first to FIG. 1, pretreated wood chips are fed to a primary refiner 10 where they are milled at elevated pressure. The high concentration pulp thus produced is then fed to a secondary refiner 12 which is at atmospheric pressure. Finally the pulp is fed to a bleach tower 14 for post bleaching. At each of these three stages, an alkaline bleach liquor is added from a source 16.

A series of trials was carried out to establish the optimum conditions for the process of the invention. The experimental details of these trials are as follows:

MECHANICAL PULPING

Refining was done in a Sunds 20 inch (50.8 cm) single rotating disk refiner, having a production rate of approximately 1 Kg OD pulp/min. The primary refiner (OVP-20) was steam pressurized at 136 KPa (20 psi). Before refining, the wood chips (Swedish Spruce) were treated with 0.3% DTPA, steamed in a preheater (124° C.) for 3 minutes and discharged into the refining zone. Dilution water was fed to the eye of the refiner by metering pumps. The resulting pulp had a freeness of approximately 350 ml CSF, and 18% consistency. For the bleaching runs, hydrosulfite solution was prepared at the required concentration and substituted for the diluted water.

Secondary refining (ROP-20 Refiner) was carried out at atmospheric conditions. Coarse pulp from the primary refiner was fed to the secondary refiner via a calibrated conveyor. The CSF freeness and consistency after the secondary stage were 150 ml and 19% respectively. Bleaching in the secondary refiner was done in the same manner as in the primary stage.

POST BLEACHING

Pulp for bleaching was collected from either refiner stage and stored in heavy gauge plastic bags. Brightness determination of the refined pulp was done immediately after refining.

Post-refiner bleaching was performed using the equivalent of 7 g OD pulp in polyethylene bags. The pulp was diluted with hot (65° C.) deionized water to 3% consistency, sealed and mixed to disperse the fiber. The required amount of hydrosulfite was added under nitrogen purge, the bag was sealed, thoroughly mixed and placed in a constant temperature bath at 60° C. for 60 min. At the end of the bleaching period, each bag was removed from the constant temperature bath, mixed, opened and the pH measured. The pulp was then diluted to 1% consistency with deionized water and the slurry adjusted to pH 4.5 prior to handsheet formation.

Duplicate handsheets (3.5 g each) were made and air dried overnight at 50% relative humidity. Brightnesses were read on an Elrepho brightness meter and the ISO brightness reported as an average of five readings for each handsheet.

BLEACH LIQUOR GENERATION

Sodium hydrosulfite was produced in a Ventron Borol® Bleach Generating Unit from Borol® Solution and a solution of sodium bisulfite fortified with $SO_2$. The generated hydrosulfite concentration was 10%. Typically fifteen liters at the required hydrosulfite concentration was prepared from the generated hydrosulfite solution. The pH of the liquor was adjusted by adding NaOH to the required pH. The concentration of hydrosulfite was checked by iodometric titration.

Figure 2:
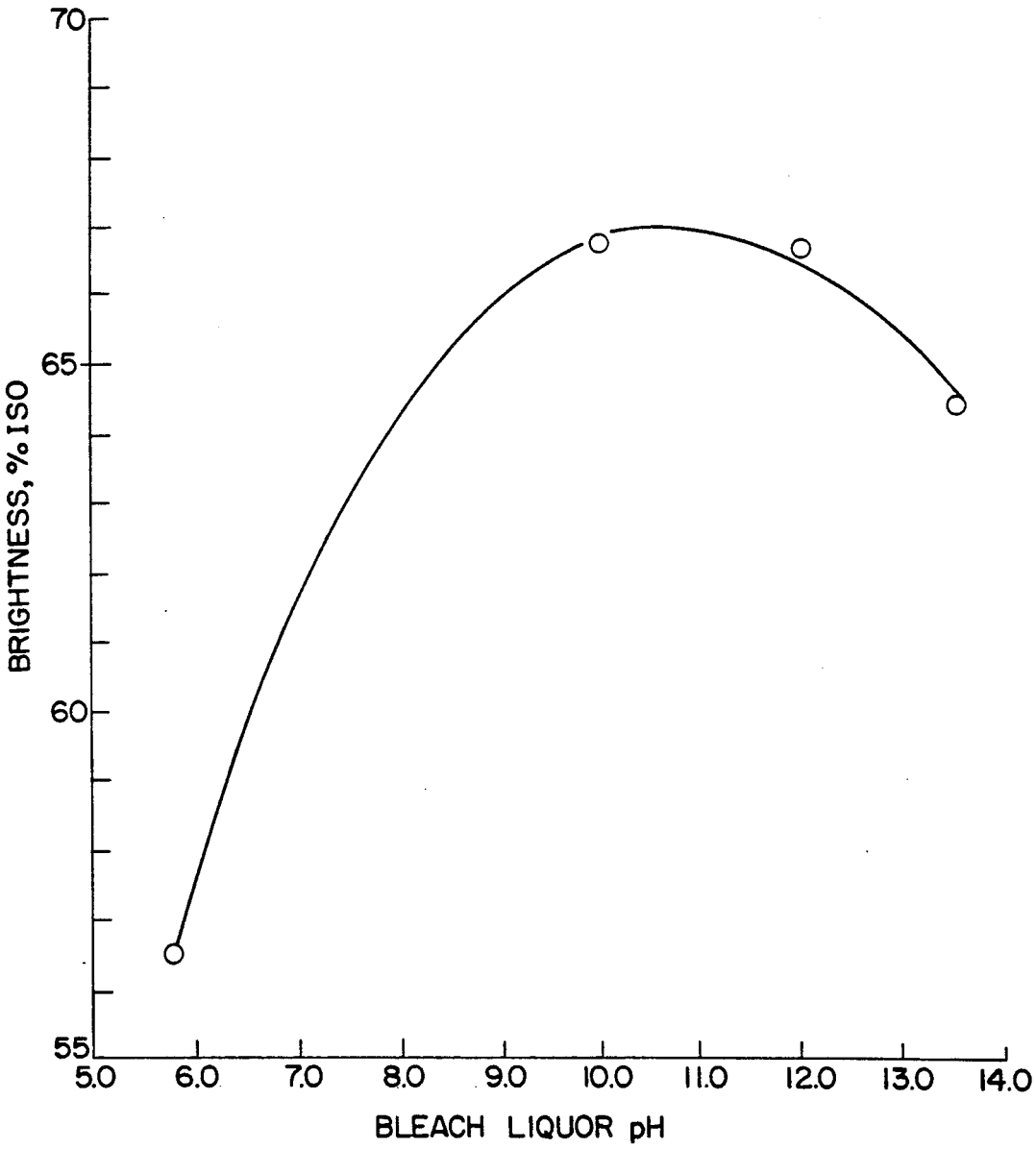
FIG. 2 shows how the brightness gain obtained from the primary refiner varies with the pH of the bleach liquor.
Figure 3:
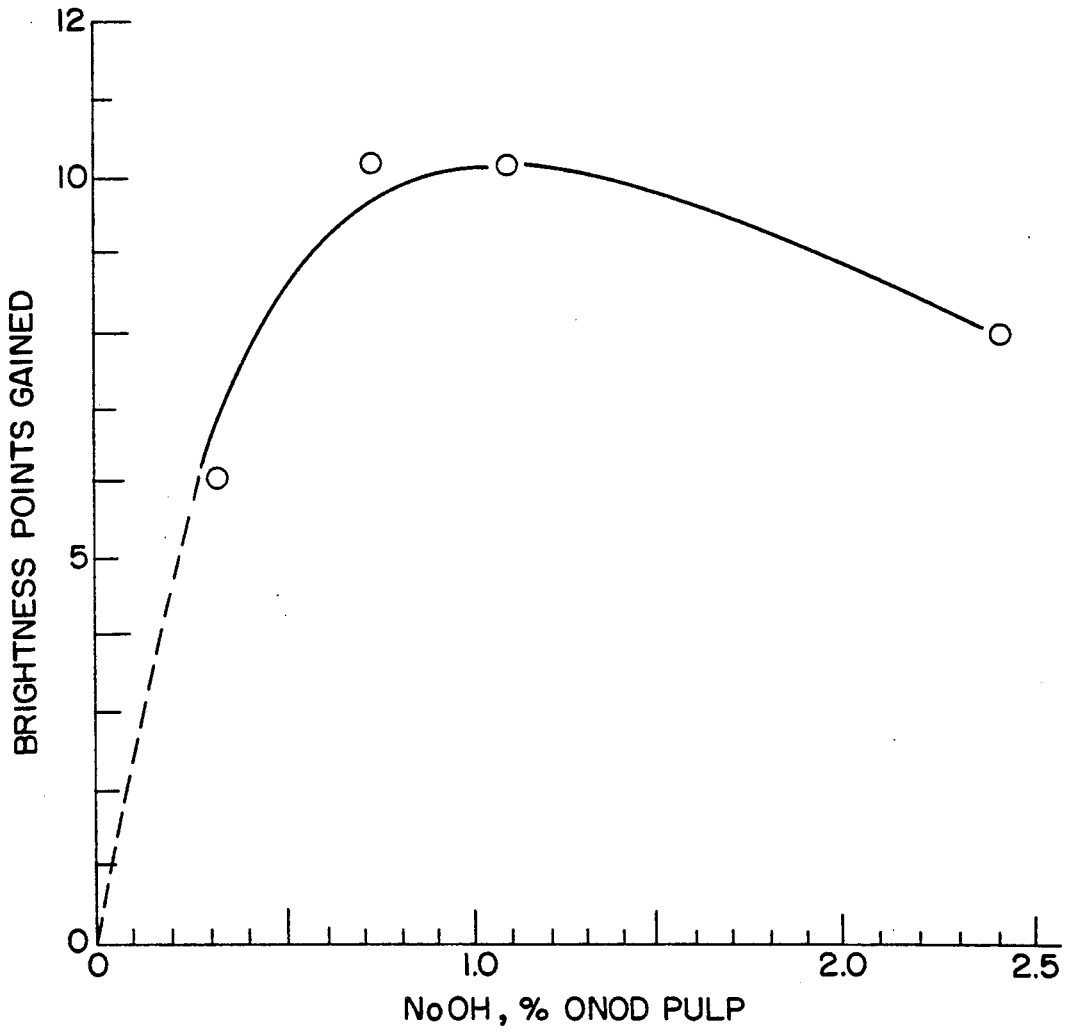
FIG. 3 shows the effect of the NaOH concentration, based on the pulp, on the brightness grain in the primary refiner.

In a first series of trials, the effect of hydrosulfite bleach liquor pH was investigated. The results are illustrated in FIG. 2. and the data summarized in table 1. To obtain maximum brightness in a pressurized refiner, alkali is provided to neutralize acidic components that are generated during refining from the extractives and resin present in softwoods. As shown in table 1 and FIG. 2, the maximum brightness, a 10 point gain, was obtained with bleach liquor that has been adjusted to pH 10 to 12 with caustic soda. Table 1 also shows the concentration of caustic soda used in each case. The variation in brightness gain with NaOH concentration is illustrated in FIG. 3.

TABLE 1

Effect of Alkalinity on Primary Refiner Brightness

| Primary Refiner Code | $Na_2S_2O_4$, % on OD wood | Bleach Liquor pM | NaOH, % on OD Wood | Discharge pH | Brightness % ISO | ΔBr |
|---|---|---|---|---|---|---|
| 1012 | | | | 4.8 | 56.4 | — |
| | 0.1 | 10 | 0.2 | — | 60.9 | 4.5 |
| | 0.2 | 10 | 0.3 | — | 62.7 | 6.3 |
| | 0.3 | 10 | 0.5 | 5.0 | 66.7 | 10.3 |
| | 0.5 | 10 | 0.8 | — | 65.2 | 8.8 |
| | 1.0 | 10 | 1.6 | — | 65.0 | 8.6 |
| 1013 | 0.3 | 12.0 | 1.0 | 5.3 | 66.7 | 10.3 |
| 1014 | 0.3 | 13.5 | 2.5 | 7.0 | 64.5 | 8.1 |

Constant Conditions

| | | |
|---|---|---|
| Primary Refiner: | Preheater Pressure, kPa | 136 |
| | Preheater Temp., °C. | 124 |
| | Preheater Time, min | 3 |
| | Discharge Consistency, % | 18.5 |
| | Freeness, CSF, ml. | 350 |
| | DTPA, % on OD Wood | 0.3 |
| | Pulp Consistency | 18.5 |
| | Specific energy consumption, kwh/Tonne | 1720 |

Note: ΔBr Brightness gain relative to unbleach brightness.

Table 1 and FIG. 3 suggest that under the conditions investigated no more than 1 wt. % NaOH should be used, the optimum occurring in the range of 0.8 to 1.0 wt. %.

In a second series of trials, the amount of hydrosulfite added to the primary refiner charge was varied from 0.1 to 1.0 wt. % based on OD pulp. The results are shown in table 2, which also gives the constant reaction conditions, and in FIG. 4 of the drawings.

TABLE 2

Effect of Additional Hydrosulfite Charge in Post-Refiner Bleaching.

| Primary Refiner Code | $Na_2S_2O_4$, % on OD Pulp[1] | pH Initial | pH Final | Brightness, % ISO | ΔBr[2] |
|---|---|---|---|---|---|
| 1012 | — | — | — | 56.4 | |
| | 0.0 | 4.8 | 5.0 | 66.7 | 10.3 |
| | 0.15 | 5.2 | 5.0 | 68.6 | 12.2 |

TABLE 2-continued

Effect of Additional Hydrosulfite Charge in Post-Refiner Bleaching.

| | | | | | |
|---|---|---|---|---|---|
| | 0.3 | 5.3 | 5.4 | 68.6 | 12.2 |
| | 0.5 | 5.5 | 5.3 | 68.9 | 12.5 |
| | 0.7 | 5.4 | 5.2 | 69.3 | 12.9 |
| | 1.0 | 5.4 | 5.7 | 69.3 | 12.9 |
| 1013 | — | — | — | 56.4 | |
| | 0.0 | 4.8 | 5.3 | 66.7 | 10.3 |
| | 0.3 | 5.7 | 5.7 | 68.1 | 11.7 |
| | 0.5 | 6.2 | 5.6 | 68.3 | 11.9 |
| | 0.7 | — | 5.7 | 69.0 | 12.6 |
| | 1.0 | — | 5.6 | 68.8 | 12.4 |
| 1014 | — | — | — | 56.4 | — |
| | 0.0 | 4.8 | 7.0 | 64.5 | 8.10 |
| | 0.3 | 6.4 | 6.2 | 65.6 | 9.2 |
| | 0.5 | 6.6 | 6.2 | 65.5 | 9.1 |
| | 0.7 | 5.7 | 5.6 | 67.3 | 10.9 |
| | 1.0 | 5.6 | 5.7 | 67.2 | 10.8 |

Constant Conditions

| | | |
|---|---|---|
| Refiner Bleaching | $Na_2S_2O_4$, % on OD pulp. | 0.3 |
| Post-Refiner Bleaching. | Consistency, % | 3.0 |
| | Temperature °C. | 60 |
| | Time, min. | 60 |

Notes:
[1]Additional hydrosulfite charge for post-refiner bleaching.
[2]ΔBr Brightness difference between bleached and unbleached.

Figure 4:
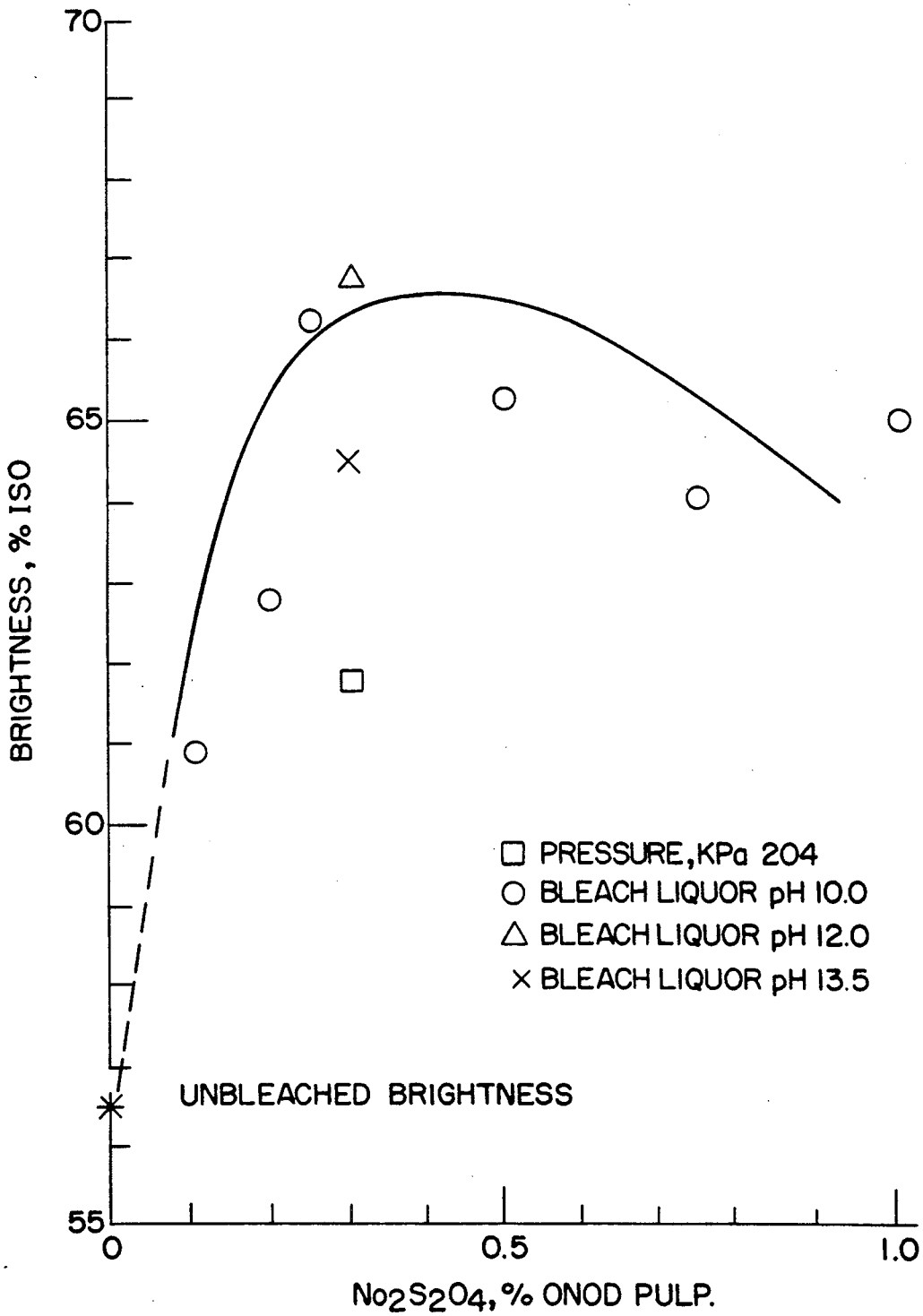
FIG. 4 shows how the brightness gain obtained from the primary refiner varies with the hydrosulfite concentration in the refiner.

As can be seen from Table 2 and FIG. 4, a maximum gain of 10.3 brightness points above the unbleached brightness was obtained at a treat level of 0.3% hydrosulfite. Increasing hydrosulfite above this level resulted in decreased brightness presumably because of the high level of caustic soda present. This demonstrates that reductive bleaching carried out in the refining zone is more efficient than conventional low consistency bleaching, suggesting that continuous fracturing of wood exposes chromophores that are readily accessible to reduction by dithionite anion, probably via the sulfoxylate radical anion. These ga-solid reactions are exceedingly rapid and very efficient; hence achieving a large brightness gain for a small amount of hydrosulfite expended. While condensation reactions of lignin during refining can result in the further formation of chromophoric groups in the pulp, reduction of these chromophores may occur in situ because of the presence of dithionite thus minimizing their effect on brightness. In addition the refining zone is oxygen free and the decomposition of hydrosulfite by air oxidation s thereby minimized.

Although not thoroughly investigated, there appears to be a pressure optimum. Increasing the pressure in the primary refiner to 204 KPa (30 psi) resulted in only a 5 point brightness gain compared to 10 point brightness gain at 136 KPa (20 psi). One can hypothesize that a threshold limit for hydrosulfite stability has been approached at this elevated pressure (temperature) and insufficient hydrosulfite is available for bleaching.

Figure 5:
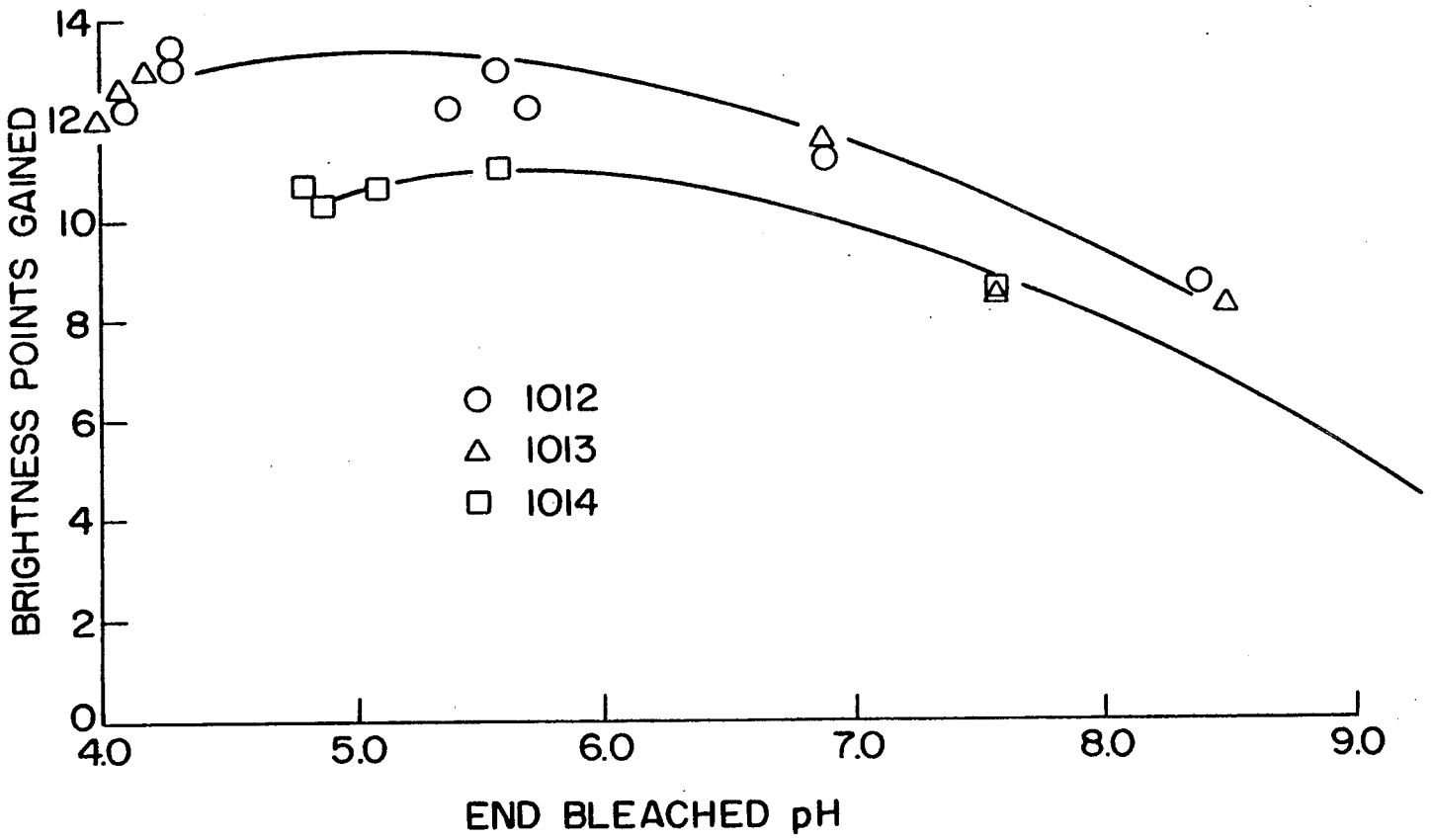
FIG. 5 shows the relationship between the brightness gain in the primary refiner and the pH of the pulp leaving the refiner.

Good bleaching practice also dictates that the post bleaching should be optimized. FIG. 5 illustrates the effect of end bleached pH on brightness point gain. The uppermost curve represents primary refiner bleached pulp treated with 0.3% hydrosulfite and bleach liquor pH adjusted to 10 and 12 respectively. Here the maximum brightness gain, 13.5 points, was obtained at an end pH of 5.0, and a total hydrosulfite charge of 0.6%. Where the bleach liquor was adjusted to a pH 13.5, the optimum pH was found to be 5.8, and the overall brightness gain was only 11 points for the equivalent total hydrosulfite applied. These results are also set out in Table 3.

TABLE 3

Effect of pH on Post Brightness - Primary Refiner

| Primary Refiner Code | pH Initial | pH Final | Brightness, % ISO | ΔBr[1] |
|---|---|---|---|---|
| 1012 | — | — | 66.7 | — |
| | 4.3 | 4.3 | 69.8 | 3.1 |
| | 4.2 | 4.3 | 69.5 | 2.8 |
| | 4.1 | 4.2 | 69.1 | 2.4 |
| | 5.8 | 5.6 | 69.3 | 2.6 |
| | 7.3 | 6.9 | 68.5 | 1.8 |
| | 9.5 | 8.4 | 55.5 | 0 |
| 1013 | — | — | 66.7 | — |
| | 4.2 | 4.2 | 69.4 | 2.7 |
| | 4.1 | 4.1 | 69.2 | 2.5 |
| | 3.9 | 4.0 | 68.8 | 1.9 |
| | 5.4 | 5.3 | 67.6 | 0.9 |
| | 7.3 | 6.9 | 67.8 | 1.1 |
| | 9.7 | 8.5 | 64.7 | — |
| 1014 | — | — | 64.5 | — |
| | 5.2 | 5.1 | 67.3 | 2.8 |
| | 5.0 | 4.9 | 67.2 | 2.7 |
| | 4.8 | 4.8 | 67.3 | 2.8 |
| | 5.7 | 5.6 | 67.5 | 3.0 |
| | 8.4 | 7.6 | 65.2 | 0.7 |
| | 10.8 | 9.5 | 61.2 | — |

Constant Conditions:

| | |
|---|---|
| $Na_2S_2O_4$, % on OD Pulp | 0.3 |
| Consistency, % | 3.0 |
| Temp. °C. | 60 |
| Time, °C. | 60 |

NOTES:
[1]ΔBr is brightness difference between caustic treated and untreated pulp.

In practical applications of refiner bleaching, pulp bleached in the refiner system must have the latency removed, be screened and cleaned before it is utilized in the paper making area. Some brightness reversion will occur on these processing operations. The effect of post bleaching on final pulp brightness is shown in FIGS. 6 and 7.

Figure 6:
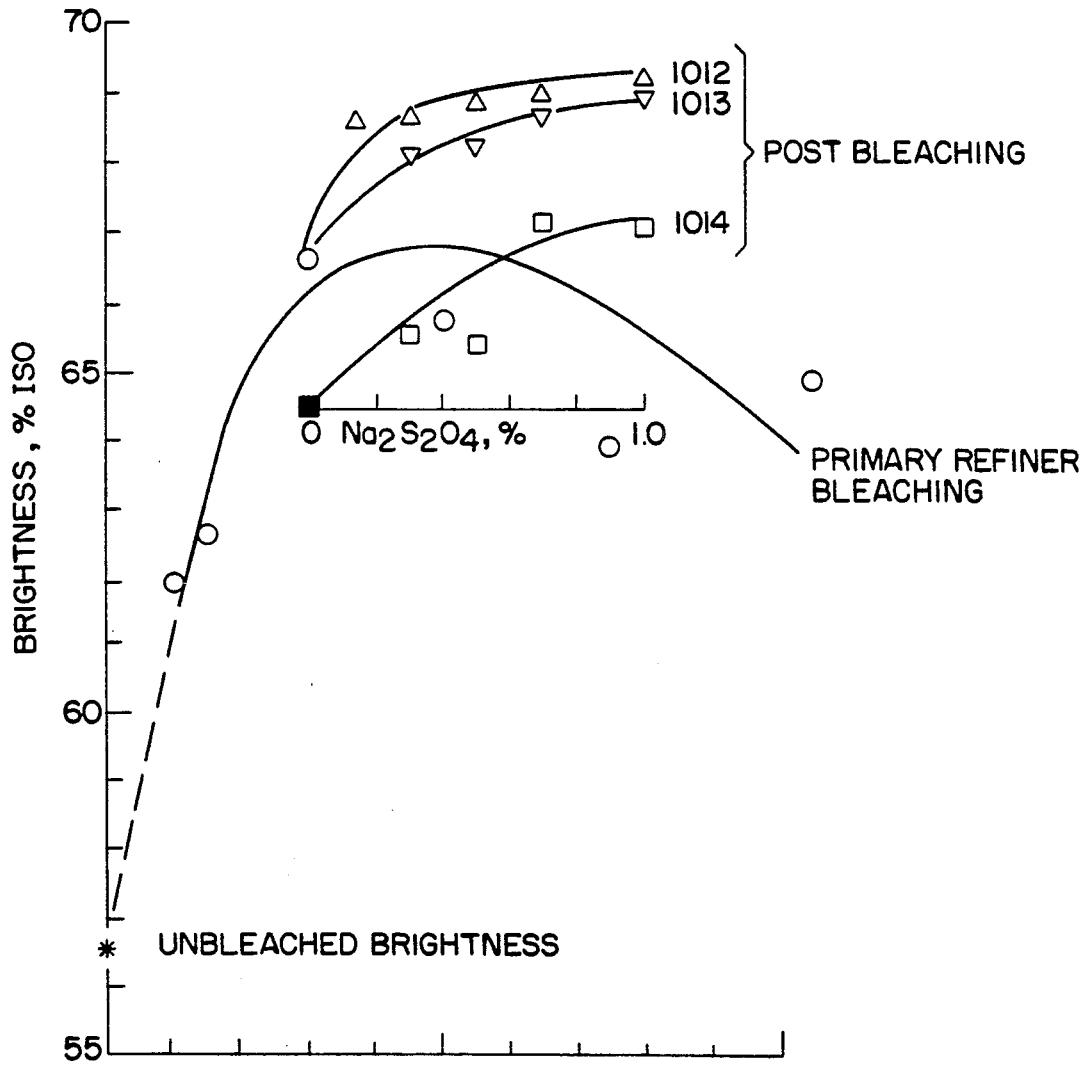
FIG. 6 illustrates the effect of post-bleaching on pulp leaving the primary refiner.
Figure 7:
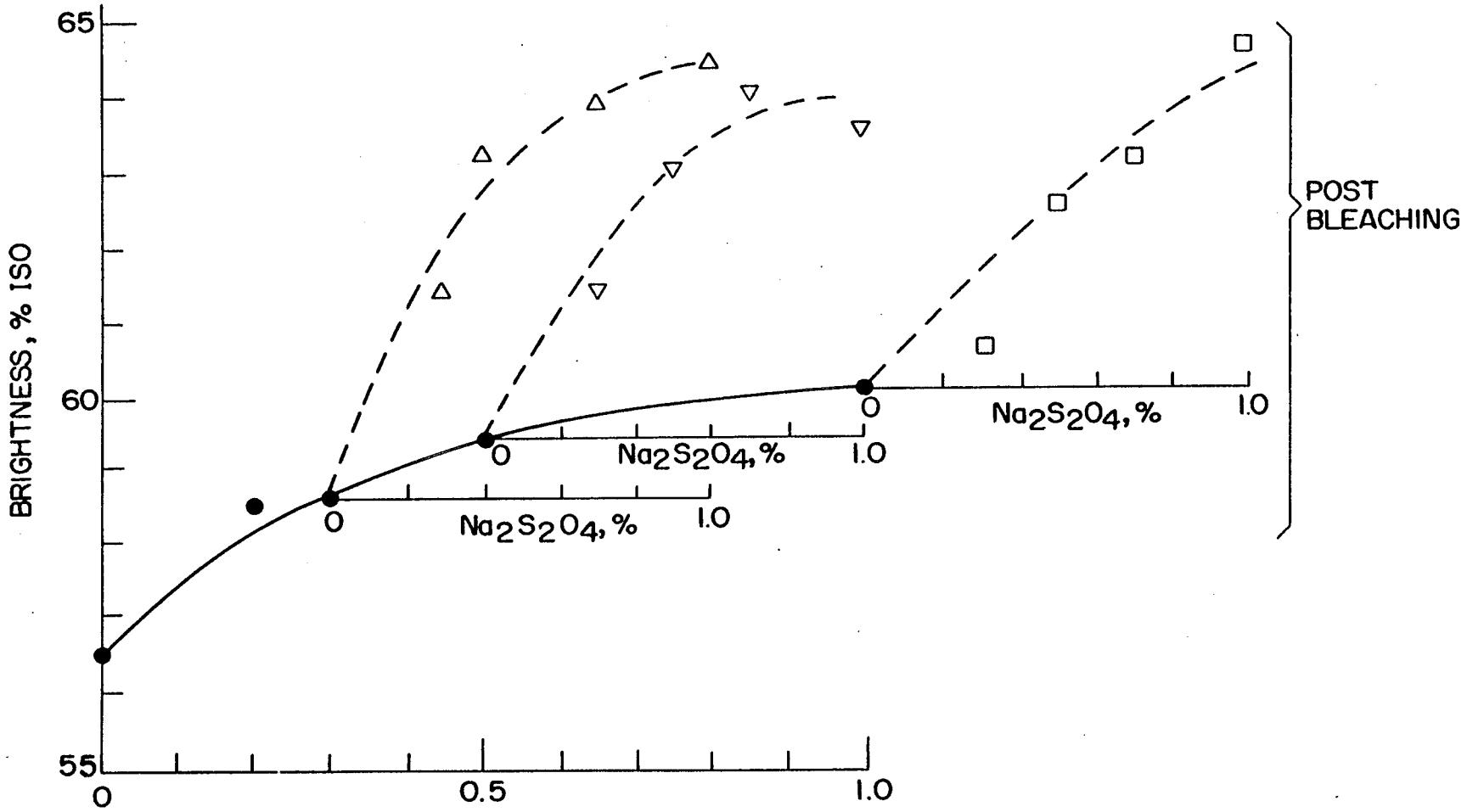
FIG. 7 shows brightness gains obtained by bleaching in the secondary refiner and by post bleaching and FIG. 8 shows how the brightness gain varies with the distribution of hydrosulfite input between primary and secondary refiners, with and without post-bleaching.

FIG. 6 illustrates the bleach response at optimized conditions for both the primary refiner bleaching and post bleaching. Brightness gains in the range of 10 to 13.5 points can be obtained with the hydrosulfite level currently used in low consistency bleaching. An added benefit may be that under refiner bleaching conditions relatively lower levels of hydrosulfite are applied and thiosulfate formation should be minimized. However this still remains to be evaluated.

As has been mentioned above, a chelating agent can also be used. High usage rates of organic chelant such as DTPA or EDTA should however be used with caution since they are alkaline solutions. Their contribution to the overall alkalinity should not exceed the alkalinity limit set by an optimized refiner bleaching system.

SECONDARY REFINER (ATMOSPHERIC) BLEACHING

Hydrosulfite bleaching under atmospheric refining conditions was also investigated. Since the primary refiner and secondary refiner were not interconnected, pulp from the primary refiner was hand carried in plastic bags to the conveyor system feeding the secondary refiner. All bleaching done in the secondary refiner used hydrosulfite bleach liquor adjusted to pH 10. No pH optimization studies were carried out. The result (FIG. 7, main curve, and table 4) shows modest brightness gains (2 to 4 points) from the secondary refiner. Post bleaching contributed an additional 6 brightness points when 1.0% hydrosulfite was used. Thus overall brightness gain of 8 to 10 points were achieved at applied hydrosulfite level (0.5% to 1.0%) typically used in conventional hydrosulfite bleach systems. The post bleaching results are shown in Table 5 and in three broken lines in FIG. 7.

TABLE 4

Effect of Hydrosulfite Charge Secondary Refiner Brightness.

| Secondary Refiner Code | $Na_2S_2O_4$, % on OD Wood. | Bleach Liquor pH | NaOH, % on OD Wood. | Discharge pH | Brightness, % ISO | ΔBr |
|---|---|---|---|---|---|---|
| | — | — | — | 4.8 | 56.4 | — |
| 1221 | 0.2 | 10.0 | 0.2 | 4.9 | 58.4 | 1.7 |
| 1222 | 0.3 | 10.0 | 0.4 | 4.4 | 58.5 | 2.1 |
| 1223 | 0.5 | 10.0 | 0.6 | 4.3 | 59.3 | 2.9 |
| 1224 | 1.0 | 10.0 | 1.1 | 4.3 | 60.1 | 3.7 |

Constant Condition

| | | |
|---|---|---|
| Secondary Refiner: | Preheater Pressure, kPa | atm |
| | Discharge Consistency, | 19% |
| | Freeness, CSF, ml | −150 |
| | DTPA, % on Wood | 0.3 |

NOTES:
ΔBr is brightness difference between bleached and unbleached pulp.

TABLE 5

Effect of Hydrosulfite Charge on Post-Bleach brightness, secondary refiner.

| Secondary Refiner Code | $Na_2S_2O_4$, % on OD Pulp | pH Initial | pH Final | Brightness, % ISO | $ΔB_1$ | $ΔB_2$ |
|---|---|---|---|---|---|---|
| 1222 | | 4.0 | | 56.4 | — | — |
| | 0.3 | — | 4.4 | 58.5 | — | 2.1 |
| | 0.3 | 5.7 | 6.2 | 61.3 | 2.8 | 4.9 |
| | 0.5 | 5.9 | 6.7 | 63.2 | 4.70 | 6.8 |
| | 0.7 | 5.8 | 7.0 | 63.8 | 5.3 | 7.4 |
| | 1.0 | 5.9 | 7.3 | 64.4 | 5.9 | 8.0 |
| 1223 | | — | — | 56.5 | — | — |
| | 0.5[2] | — | 4.3 | 59.3 | — | 2.9 |
| | 0.3 | 6.0 | 6.1 | 61.4 | 2.1 | 5.0 |
| | 0.5 | 6.0 | 6.5 | 63.0 | 3.7 | 6.6 |
| | 0.7 | 5.7 | 6.8 | 64.3 | 5.0 | 7.9 |
| | 1.0 | 5.9 | 7.1 | 64.0 | 4.7 | 7.6 |
| 1224 | | — | — | 56.4 | — | — |
| | 1.0[3] | — | 4.3 | 60.4 | — | 4.0 |
| | 0.3 | 5.7 | 6.0 | 60.5 | 0.1 | 4.1 |
| | 0.5 | 5.7 | 6.5 | 62.5 | 2.1 | 6.1 |
| | 0.7 | 5.7 | 7.0 | 63.6 | 3.2 | 7.2 |
| | 1.0 | 5.8 | 7.2 | 64.6 | 4.2 | 8.2 |

Constant Conditions:

| | |
|---|---|
| Consistency, % | 3.0 |
| Temp., °C. | 60 |
| Time, min. | 60 |

Note:
[1,2,3]Hydrosulfite charge at secondary refiner
$ΔB_1$ Brightness gain relative to refine bleached brightness
$ΔB_2$ Overall brightness gain ie. refiner bleach and post bleach.

The reduced brightness gain during secondary refiner bleaching can be attributed to insufficient alkalinity. This is demonstrated (table 4) by the more acidic (pH 4.4) discharge pulp pHs. As shown in the primary refiner, caustic should preferably be added at a level such that the refiner discharge pulp pH is in the range of 5.0–5.5. It is assumed that more acidic conditions must have been present in the secondary refining system. At the high temperature in the refining zone significant quantities of hydrosulfite may have decomposed resulting in a minimum number of chromophores being reduced and hence lower brightness.

Figure 8:
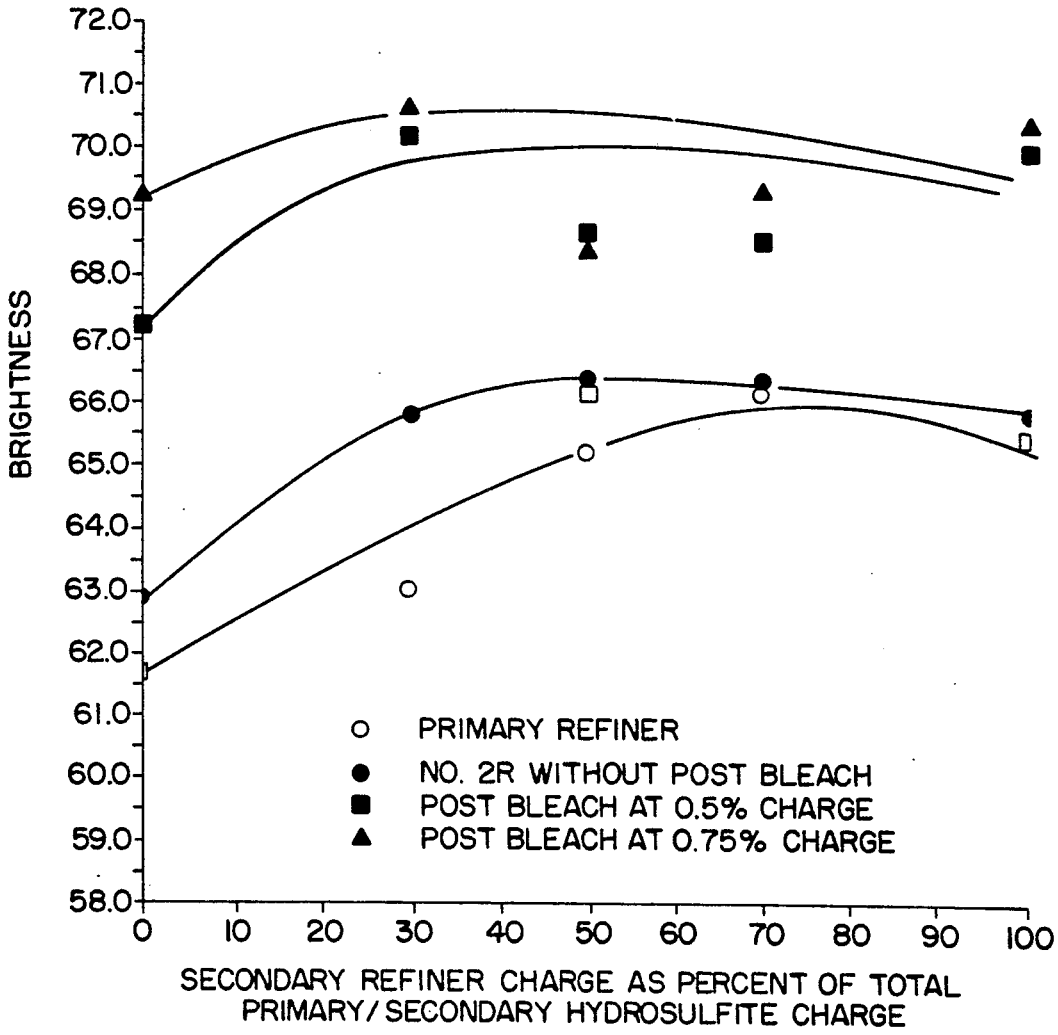

In a final series of trials, a total hydrosulfite charge of 1% was split between the primary and secondary refiners in different ratios. FIG. 8 shows the results obtained without post bleaching and with post bleaching with additional hydrosulfite inputs of 0.5 and 0.75%. For comparison, the results obtained with primary refiner bleaching alone, at charges from 0.3 to 1.0%, are also shown.

In appears from FIG. 8 that the total hydrosulfite charge should preferably be split at a ratio between the primary and secondary refiners from 70:30 to 60:40.

It is believed that by stabilizing the hydrosulfite against decomposition, the process of the invention also helps to reduce chemical attack on the apparatus and other problems caused by the decomposition products of sodium hydrosulfite.

What is claimed is:

1. A process for simultaneously refining and bleaching wood pulp in a refiner to provide pulp of improved brightness comprising concurrently introducing bleach liquor and pulp or wood chips in one or more refiners including a primary pressurized refiner and wherein the bleach liquor comprises a solution of sodium hydrosulfite and sodium hydroxide, said solution having an alkaline pH of from about pH 10 to about pH 13 and wherein not more than about 2% by weight of sodium hydrosulfite, based on the total weight of the pulp or wood chips, is added, and the pulp is discharged from the refiner at a pH of from about 5 to 6 and whereby the bleaching produces a brightness gain of at least about 8 to 13 ISO points in the refiners.

2. A process as claimed in claim 1, wherein after leaving said pressurized refiner the pulp is subjected to further bleaching in an atmospheric refiner.

3. A process as claimed in claim 2, wherein after leaving said atmospheric refiner the pulp is subjected to further bleaching in a bleaching tower.

4. A process as claimed in claim 1, wherein the sodium hydroxide is added in a concentration, based on the total pulp, of not more than about 1 wt. %.

5. A process as claimed in claim 4, wherein said sodium hydroxide concentration is from about 0.8 to about 1 wt. %.

6. A process as claimed in claim 1, wherein not more than about 1% by weight of sodium hydrosulfite is added, based on the total pulp.

7. A process as claimed in claim 1, wherein a chelating agent is added to the pulp or wood chips being bleached.

8. A process as claimed in claim 7, wherein the chelating agent is selected from the group comprising ethylene diamine tetraacetic acid (EDTA) and diethylene tetramine pentaacetic acid (DTPA).

9. A process as claimed in claim 1, wherein the bleach liquor solution has a pH of from about pH 10 to 12.

10. A simultaneous wood pulp refining and bleaching process which comprises the steps of:

feeding wood chips to a primary pressurized refiner and milling said wood chips at elevated pressure to produce a high-concentration pulp;

feeding to said pressurized refiner, during said milling, an alkaline bleach liquor comprising a solution of sodium hydrosulfite and sodium hydroxide, said solution having a pH of from about 10 to about 13;

discharging said high-concentration pulp from the pressurized refiner at a pH of from about pH 5 to 6, passing said high-concentration pulp to a secondary refiner and further refining said high-concentration pulp in said secondary refiner at atmospheric pressure;

adding further said alkaline bleach liquor to the pulp in said secondary refiner;

passing the pulp from said secondary refiner to a bleaching tower, and bleaching said pulp in said bleaching tower with more of said alkaline bleach liquor, wherein the total amount of sodium hydrosulfite added is not more than about 2% by weight of sodium hydrosulfite, based on the total weight of pulp and wood chips is added, and whereby the bleaching produces a brightness gain of at least about 10 to 13 ISO points in the refiners.

11. A process as claimed in claim 10, wherein the bleach liquor solution has a pH of from about pH 10 to 12.

12. A process as claimed in claim 10, wherein the sodium hydroxide is added to a concentration, based on the total pulp, of not more than about 1 wt. %.

13. A process as claimed in claim 12, wherein said solution has a sodium hydroxide concentration of from about 0.8 to about 1 wt. %.

14. A process as claimed in claim 10, wherein not more than about 1 wt. % of sodium hydrosulfite is added, based on the total weight of the pulp.

15. A process as claimed in claim 10, wherein a chelating agent is added to the pulp to be bleached.

16. A process as claimed in claim 15, wherein the chelating agent is selected from the group comprising ethylene diamine tetraacetic acid (EDTA) and diethylene tetramine pentaacetic acid (DPTA).

* * * * *